US008629580B2

(12) United States Patent
Johnson et al.

(10) Patent No.: US 8,629,580 B2
(45) Date of Patent: Jan. 14, 2014

(54) AUDIO ACCESSORY TYPE DETECTION AND CONNECTOR PIN SIGNAL ASSIGNMENT

(75) Inventors: Timothy M. Johnson, San Jose, CA (US); Xingqun Li, San Jose, CA (US); Yehonatan Perez, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 475 days.

(21) Appl. No.: 13/023,843

(22) Filed: Feb. 9, 2011

(65) Prior Publication Data

US 2012/0200172 A1 Aug. 9, 2012

(51) Int. Cl.
*H01H 35/00* (2006.01)

(52) U.S. Cl.
USPC ..... 307/116

(58) Field of Classification Search
USPC ..... 307/116
See application file for complete search history.

(56) References Cited

U.S. PATENT DOCUMENTS

| | | | |
|---|---|---|---|
| 4,922,547 | A | 5/1990 | Murata |
| 5,794,163 | A | 8/1998 | Paterson et al. |
| 6,266,571 | B1 | 7/2001 | Fado et al. |
| 6,470,197 | B1 | 10/2002 | Tuoriniemi et al. |
| 6,615,059 | B1 | 9/2003 | Pehrsson et al. |
| 6,988,905 | B2 | 1/2006 | Corey et al. |
| 7,050,783 | B2 | 5/2006 | Curtiss et al. |
| 7,248,707 | B2 | 7/2007 | Peng et al. |
| 7,450,726 | B2 | 11/2008 | Goyal |
| 7,564,966 | B2 | 7/2009 | Sano |
| 7,623,667 | B2 | 11/2009 | Sander et al. |
| 7,627,128 | B2 | 12/2009 | Sander et al. |
| 7,633,963 | B1 | 12/2009 | Anderson et al. |
| 7,836,216 | B2 | 11/2010 | Kashi et al. |
| 7,912,501 | B2 | 3/2011 | Johnson et al. |
| 2004/0175993 | A1 | 9/2004 | Chennakeshu |
| 2005/0090141 | A1 | 4/2005 | Peng et al. |
| 2005/0164631 | A1 | 7/2005 | Jin |
| 2007/0049103 | A1 | 3/2007 | Kashi et al. |
| 2008/0130911 | A1 | 6/2008 | Tsen |
| 2008/0164994 | A1 | 7/2008 | Johnson et al. |

(Continued)

FOREIGN PATENT DOCUMENTS

| | | |
|---|---|---|
| EP | 1199867 A1 | 4/2002 |
| JP | 2001169385 | 6/2001 |
| TW | 1266551 | 11/2006 |

OTHER PUBLICATIONS

"Analog Audio Classification Using Device Impedance Characteristics", Windows Platform Design Notes, Copyright 2002 Microsoft Corporation, Version 1.0—Apr. 16, 2002, 15 pages.

(Continued)

*Primary Examiner* — Jared Fureman
*Assistant Examiner* — Duc M Pham
(74) *Attorney, Agent, or Firm* — Blakely, Sokoloff, Taylor & Zafman LLP

(57) ABSTRACT

An electronic audio host device has an audio accessory connector with multiple pins. An ultrasonic test signal source has an output coupled to a first pin of the connector. A programmable switch circuit couples a second or third pin of the connector, to a ground of the audio host device. A controller measures a signal on one of the pins of the connector while the test signal source is on, and compares the measured signal to a predetermined, stored signature. The signature is associated with one of several different accessory plug pin assignments for the connector, which can be configured using the programmable switch circuit. Other embodiments are also described and claimed.

21 Claims, 7 Drawing Sheets

(56) References Cited

U.S. PATENT DOCUMENTS

| | | | |
|---|---|---|---|
| 2008/0165986 | A1 | 7/2008 | Daniels et al. |
| 2008/0166003 | A1 | 7/2008 | Hankey et al. |
| 2008/0318629 | A1 | 12/2008 | Inha et al. |
| 2010/0260341 | A1 | 10/2010 | Sander et al. |

OTHER PUBLICATIONS

Johnson, Timothy, et al., "Audio I O Headset Plug and Plug Detection Circuitry", U.S. Patent Continuation U.S. Appl. No. 13/038,172, filed Mar. 1, 2011, Inventors: Timothy Johnson and Achim Pantfoerder, (41 pages).

PCT International Search Report and Written Opinion (dated Jun. 8, 2012), International Application No. PCT/US2012/024330, International Filing Date—Feb. 8, 2012, (14 pages).

F3, F4 = 0,1

F3, F4 = 1,0

F3, F4 = 0,1

F3, F4 = 1,0

| HOST AUDIO DEVICE REGION CODE | PERMISSIBLE AUDIO ACCESSORY PIN ASSIGNMENTS | ASSOCIATED PIN ASSIGNMENT |
|---|---|---|
| NA | A, C | A |
| EU | A, C | A |
| AS | A, C | A |
| AS-CN | B, C | B |
| AF | A, C | A |

FIG. 10

| SELECTED PIN ASSIGNMENT | MEASURED RETURN SIGNAL OR VECTOR | USER CONFIRMS OPERATION |
|---|---|---|
| A | LOW | YES |
| B | [LOW, LOW, MEDIUM, LOW] | YES |
| A | HIGH | NO |

FIG. 11

AUDIO ACCESSORY TYPE DETECTION AND CONNECTOR PIN SIGNAL ASSIGNMENT

An embodiment of the invention relates to wired headsets used with consumer electronic audio devices. Other embodiments are also described.

BACKGROUND

A typical wired audio headset has a "tip, ring, ring and sleeve" (TRRS) connector or plug at the end of its cable, that connects with a mating socket or jack of an electronic audio host device such as an iPhone™ mobile device or an iPod™ portable media player. The TRRS connector, also referred to as a stereo connector, has four conductive contacts (generically referred to as "pins" here) to pass the following signals starting with the tip: left speaker channel (1), right speaker channel (2), microphone (3), and a shared ground or reference (4). For certain consumer markets, the ground signal is assigned to the sleeve contact (pin 4), while the microphone signal is at the ring contact (pin 3). However in other markets, those two signal assignments are reversed. Also, with headsets that only support stereo listening with no microphone, pins 3 and 4 are sometimes shorted together as a single ground contact. The host device should be able to automatically determine what type of headset has been connected to its audio jack, and then route its internal signal paths to the correct pins of the jack.

SUMMARY

An embodiment of the invention is a circuit and process in an audio host device that can automatically detect the pin assignment of a connected audio accessory, such as a headset. On that basis, the process then configures a programmable switch circuit through which the microphone signal and ground lines in the device are routed to the correct pins of a connector that may have at least three (3) pins. The programmable switch circuit may support at least two different pin assignments, e.g. a US-type headset and a Chinese-type headset where a difference between them is that the microphone and ground assignments are reversed. A third pin assignment is also possible, e.g. a stereo listen-only headset, i.e. one that has no microphone signal in its plug.

The correct pin assignment may be selected based on the following example process. A predetermined ultrasonic tone signal is transmitted through a first pin of the connector (e.g., one or both of the speaker channel pins), and a signal is measured through a second pin of the connector (e.g., any pin that is not assigned to the speaker channels). The measured signal is compared to a predetermined, stored signature that is associated with one of several different pin assignments that can be configured in the device. If there is a match, then a programmable switch circuit is configured accordingly, to set the associated pin assignment. Note that by making the test tone ultrasonic, i.e. beyond the hearing range of humans, and by carefully controlling when dc power is sent out through the connector, an audible "click" or "pop" that might be heard (by the wearer or user of the connected headset) when a dc test signal is used, can be avoided.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

FIG. 3 is a circuit schematic of a second configuration of the programmable switch circuit, while the type B audio accessory is plugged-in.

FIG. 5 is a circuit schematic of the second configuration of the programmable switch circuit, while the type A audio accessory is plugged-in.

FIG. 10 shows a look-up table of audio device region codes and associated pin assignments.

FIG. 11 is a data structure for storing pin assignments and their associated measured return signals and user confirmations.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
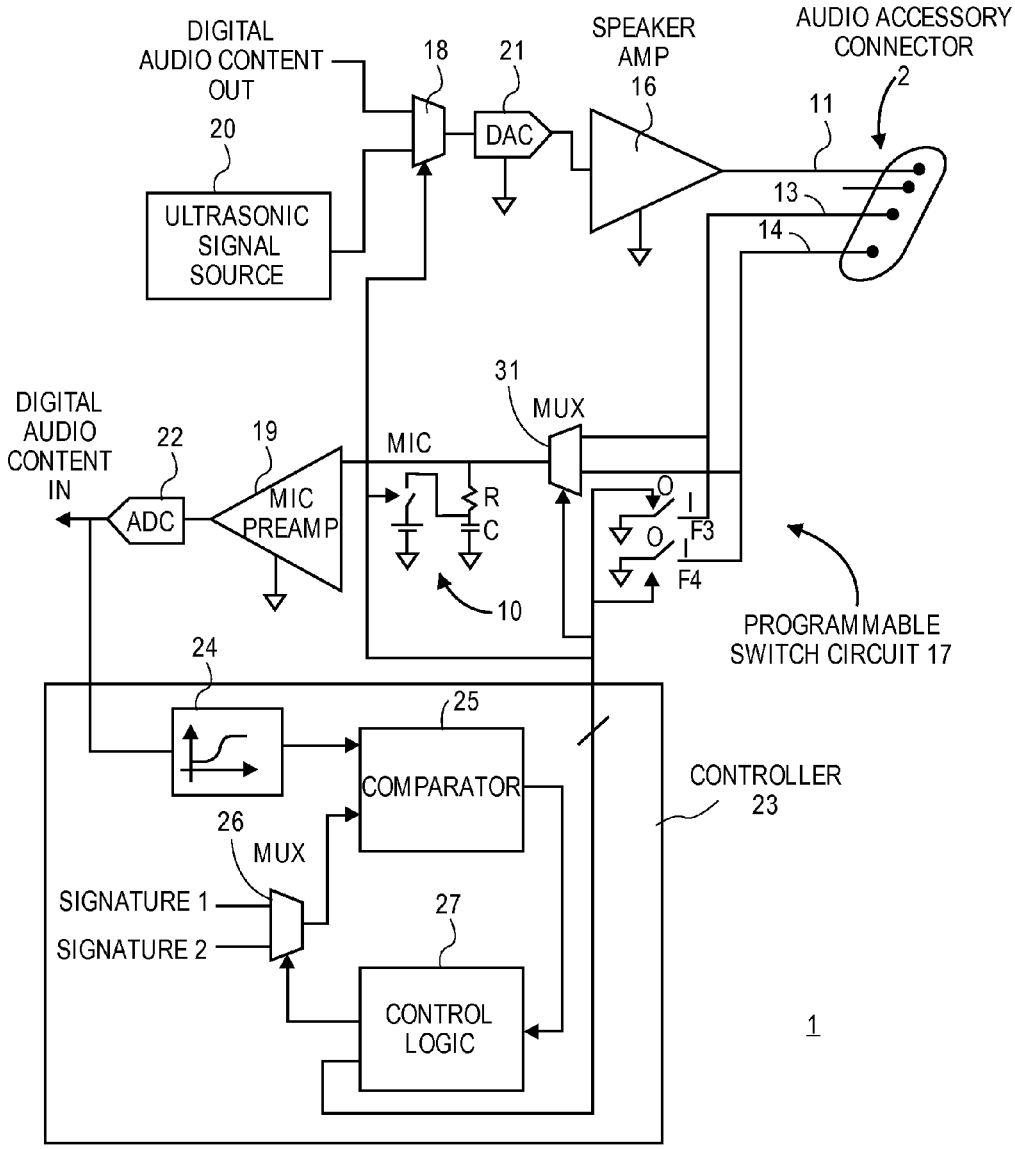
FIG. 1 is a combined circuit schematic and block diagram of relevant portions of an electronic audio host device, in accordance with an embodiment of the invention.

FIG. 1 is a combined circuit schematic and block diagram of relevant portions of an electronic audio host device 1, in accordance with an embodiment of the invention. The device 1 includes an integrated audio accessory connector 2 (e.g., a typical TRRS headset jack or headset connector) having, in this example, four pins 11, 12, 13 and 14. Pin 11 is assigned to a speaker channel that is driven by a speaker amplifier 16 relative to a local circuit ground as shown. The local circuit ground is to be routed to at least one or both of pins 13 and 14, depending upon the type of accessory that has been plugged-in to the connector 2. An input of the speaker amplifier 16 is derived from an output of a digital-to-analog converter (DAC) 21. Input to the DAC 21 is from a switch 18 (also referred to as a multiplexer) that may switch in or out, add or combine, with or without suitable scaling, one or more of at least two signals. Possible input signals to the switch 18 include a digital audio content out signal and an ultrasonic tone signal. The digital audio content out signal may contain, for example, the downlink voice during a call (if the device 1 has two-way real-time communications capability), streaming audio from a remote server (if the device 1 has the capability to connect to a remote server over the Internet), or locally generated digital music or digital audio (e.g., using a digital media player that can decode digital media files such as MP3 music files and MPEG movie files that are stored locally in the device 1).

The ultrasonic tone signal may be produced by an ultrasonic signal source 20, which may be a digital circuit that generates a predetermined test signal sequence containing one or more ac tones or frequency components that are beyond the hearing range of humans, e.g. one that has essentially no ac components that can be heard below about 20 kHz, and essentially no dc component. While the test signal is ultrasonic in that it cannot be heard by humans, its strength should not be so high as to cause damage to the speaker of the connected audio accessory (due to being amplified by the speaker amplifier 16). The ultrasonic tone may be activated by a controller 23 (as part of a headset type detection process), whenever a headset connector or other audio accessory connector has been detected as being plugged-in to the connector 2. This may be achieved using, for instance, conventional headset plug detection circuitry and methodologies (not shown and described here) that may be implemented as part of the controller 23. The controller 23 may then turn off the ultrasonic tone once it has detected the headset type or when the audio accessory has been unplugged.

The audio accessory connector 2 also has a pair of pins 13, 14, namely a microphone signal pin and a ground or reference signal pin; the signals assigned to them may be interchangeable, depending on the signals assigned in the connected audio accessory. The ground pin provides the audio accessory with a power supply return node; the node may be shared by one or more speakers and by a microphone (all of which may be part of the audio accessory). The microphone pin may be used to deliver an analog microphone signal (microphone pickup signal) from the microphone, to a microphone signal preamplifier 19. The microphone pin may also, simultaneously, serve to deliver a dc voltage and current to power the microphone. For this purpose, a dc bias circuit 10 may be provided that can be switched on and off under control of the controller 23, to provide dc power to the plugged-in audio accessory, in this case out through the microphone line of the connector 2. The dc bias circuit 10 in this example has a resistor (e.g., on the order of 1 kohm) that pulls up the microphone line of the connector 2 to the dc voltage source (when the switch is closed). The dc voltage source is ac bypassed by a capacitor (e.g., on the order of 1 microFarad) such that when the switch is open any relevant ac signal on the microphone line will be routed to ground through the resistor and the capacitor. Other circuit arrangements for providing dc power to the audio accessory are possible.

The output of the preamplifier 19 is fed to an analog-to-digital converter (ADC) 22, whose output produces a digital audio content in signal, which is then fed to the appropriate audio functions running in the device 1. For example, when a plugged-in microphone headset is being used during a call, the digital audio content in signal will contain the voice of the wearer of the headset, also referred to as an uplink voice signal, which is delivered by either pin 13 or pin 14; in that mode of operation, the speaker amplifier 16 would be driving a so-called downlink voice signal through one or more of the pins 11, 12. The speaker and microphone signals would be driven relative to a shared ground, on either pin 13 or pin 14. In another mode of operation, e.g. an interview or recording session mode, the digital audio content in signal could contain the voice of one or more users and their background sound (local to the device 1) picked up by an external microphone that has been plugged-in. The content in signal in that case could be recorded to a file (stored locally in the device 1), and/or streamed to a server over a local area network and/or an Internet connection.

The microphone (audio) signal may be amplified, using the microphone preamplifier 19, relative to the same ground that has been routed to pin 13 or pin 14, as shown. The input to the microphone preamplifier 19 in this embodiment is single-ended (see FIG. 7 for an embodiment of the invention where the microphone preamplifier 19 has a differential input). This input signal is provided by a signal output of a multiplexor 31, which is used to route any one, not both, of the signals on connector pins 13 and 14 at a time, to its signal output. In addition, pins 13 and 14 are coupled to a pair of switches F3, F4. Each switch has at least two stable states, namely one in which its respective connector pin is directly connected to the local circuit ground and one in which it is not. The open condition of the switch F3 or F4, i.e. when it does not connect its connector pin to ground through a "low impedance" path, is deemed to be a "high impedance" condition. The combination of the switches F3, F4 and the mux 31 are referred to here as a programmable switch circuit 17 which can route one of the two pins 13, 14 to a ground of the audio host device while at the same time routing the other to an input of the microphone preamplifier 19. The circuit 17 can be configured via its digital input control lines whose signals may be set by the controller 23 in order to match the microphone and ground signal pin assignments of a plugged-in audio accessory device. The programmable switch circuit 17 thus can set any one of several different pin assignments at a time.

The controller 23 is responsible for the overall process of determining or detecting which type of audio accessory has been plugged into the connector 2, and then to appropriately set or configure the programmable switch circuit 17 with the correct pin assignments, to achieve the correct routing of internal signals for the particular accessory that has been plugged-in. The controller 23 may be implemented as a combination of digital hardwired and programmable circuitry that performs the following functions: measures a signal on pin 13 or pin 14 while the ultrasonic signal source is on; compares the measured signal to a predetermined, stored signature (previously set, for instance, in a manufacturer's laboratory when the device 1 was being first developed or tested), wherein the predetermined stored signature is associated with one of several different accessory plug pin assignments with which the programmable switch circuit 17 can be configured; and configures the programmable switch circuit 17 based on the comparison.

The above-described process for adapting to the connector pin assignments of several different audio accessories may be implemented using a controller 23 that may include the following circuitry (still referring to FIG. 1): a highpass or bandpass filter 24 serves to separate or extract a "returned" signal from the output of the ADC 22 (which may also include audio content), i.e. a "returned" version of the transmitted ultrasonic test signal; a comparator 25 compares the returned signal with one or more previously stored signatures (here, there are at least two stored signatures to choose from, using a multiplexor 26); and control logic 27 to send the ultrasonic tone to the plugged-in audio accessory, turn on and turn off the microphone dc bias, select a particular state or position for the mux 31, select a particular stored signature for comparison, evaluate the comparison result to see which signature presents the closest match, and set the control signals of the programmable switch circuit 17 to configure the latter in accordance with the pin assignment that is associated with the matching signature.

Figure 8:
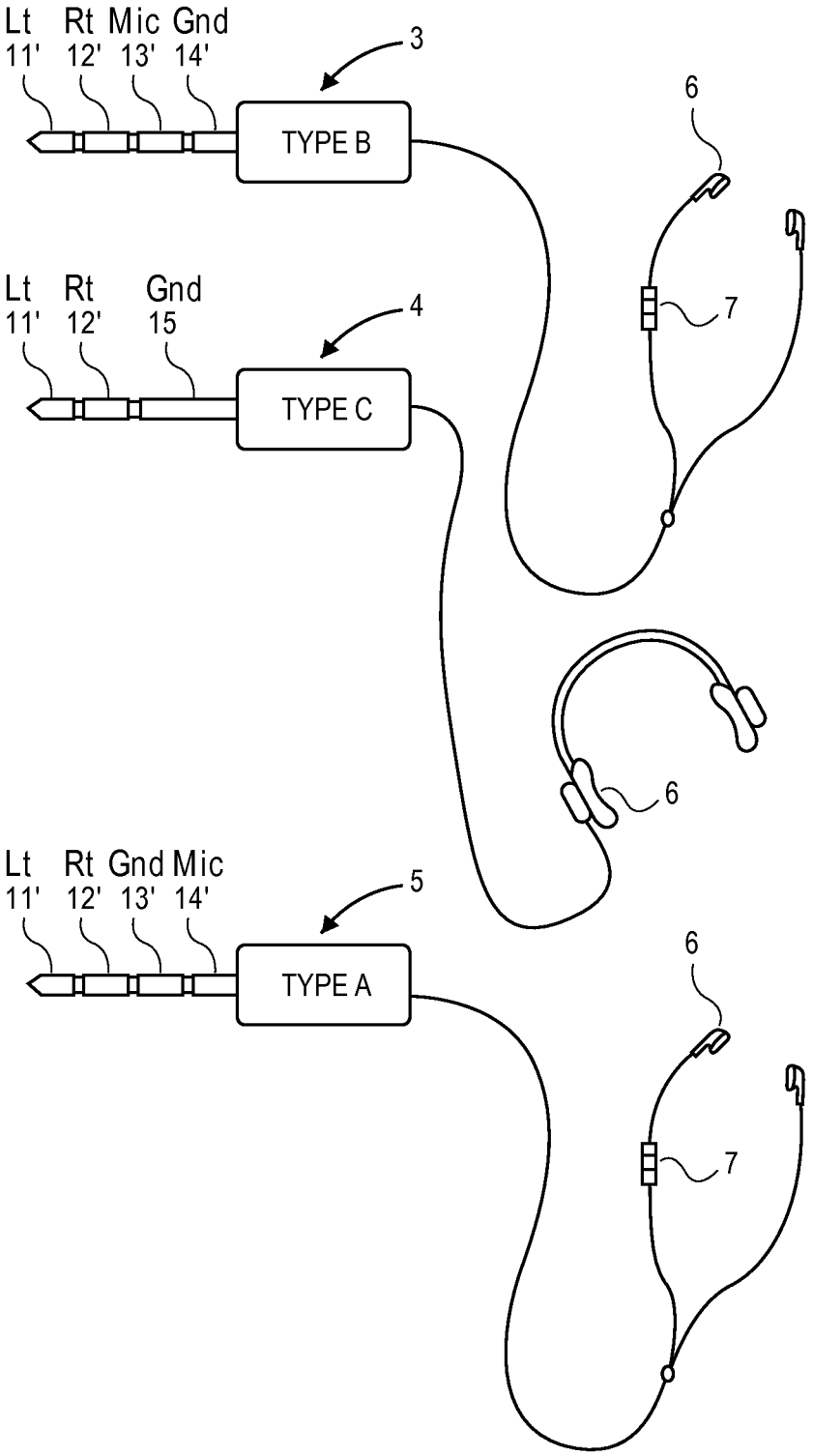
FIG. 8 depicts several different types of audio accessories.

The above described process for adapting to the connector pin assignments of several different audio accessories may be used with at least two different types of accessories, i.e. having different connector pin signal assignments. For example, see headset types A and B as depicted in FIG. 8. Each of these types of headsets has a pair of speakers 6 and a microphone 7, connected by a multi-wire cable having at its end a respective connector (plug 3 for type B, and plug 5 for type A). A difference between these two headsets is that the microphone and ground signal assignments have been reversed on pins 13' and 14'. The microphone may be internal, i.e. housed at the ear piece, or it may be an external design at the end of a boom. A third headset type C (with cabled plug 4) also has a pair of speakers 6, a single, larger ground pin 15 but no microphone (this is sometimes referred to a stereo-only headset). Other types of audio accessories are possible. For instance, there is another audio accessory whose speaker channels contain an analog front end or audio processing stage before (or in "front of") the speaker's voice coil.

Figure 2:
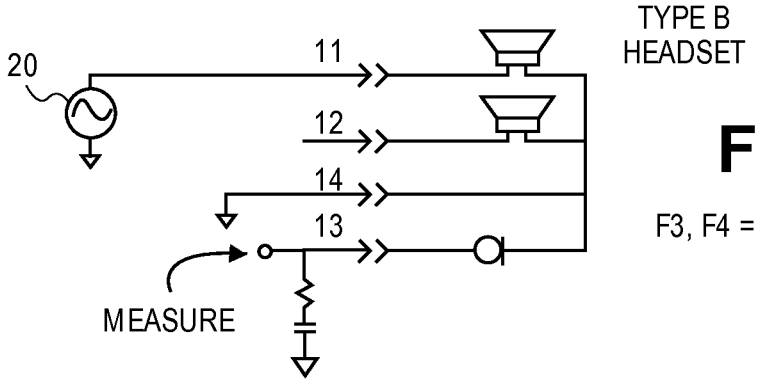
FIG. 2 is a circuit schematic of a programmable switch circuit having been configured into a first configuration while a type B audio accessory is plugged into the host device.
Figure 3:
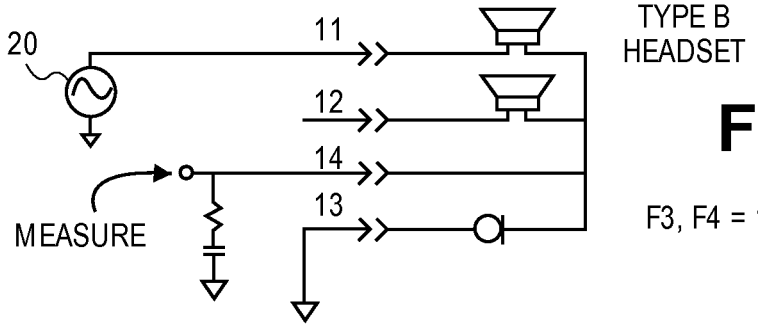
Figure 4:
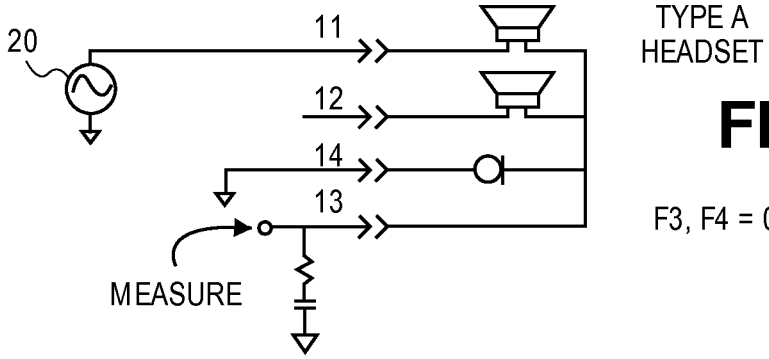
FIG. 4 is a circuit schematic of the programmable switch circuit having been configured into the first configuration while a type A audio accessory is plugged into the host device.
Figure 5:
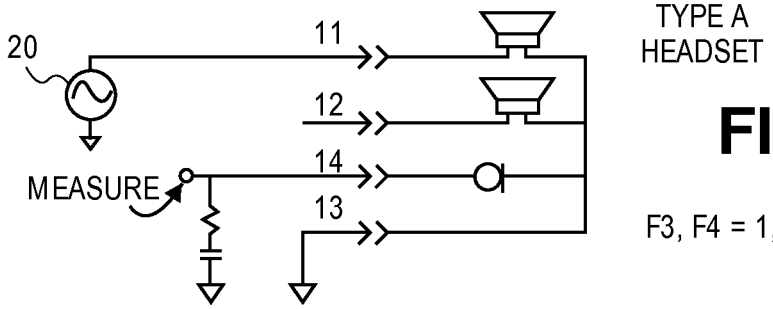

FIGS. 2-5 are circuit schematics of the programmable switch circuit 17, as it has been programmed into several different example states during an example accessory type detection process. FIGS. 2 and 3 depict two different states, respectively, while a type B headset has been plugged-in. In contrast, FIGS. 4 and 5 depict those two same configurations, but while a type A headset has been plugged-in. The state shown in FIG. 2 is obtained by setting switches F3, F4 to their 0, 1 state (see FIG. 1), while the other state is achieved by setting switches F3, F4 to their 1, 0 state. Another possible state is the 0,0 state, and other combinations of states are possible. Also, note the difference between in this case the type A headset and the type B headset, namely that the microphone signal pin is at pin 14 for the type A headset, and at pin 13 for the type B headset. The shared ground or power supply return assignment is, similarly, reversed for those two types of headsets. The node at which the return signal is to be measured may be kept the same for all states of the programmable switch circuit 17, by keeping the mux 31 in a single or default position, during the entire type detection process. Alternatively (as described here), the measurement may be on different nodes for different states of the switch 17, e.g. in FIGS. 2 and 4 the measurements are on pin 13, while in FIGS. 3 and 5 the mux 31 has been moved to a different position namely pin 14.

An example process for adapting to the connector pin assignments of two different headsets may be as follows. Referring to the flow diagram of FIG. 6, while the switch 17 is configured into its state F3, F4=1,0 (operation 31), and the ultrasonic source 20 is active and has been routed to one or more of the pins 11, 12, a signal is measured on pin 14 (operation 28). If the measured signal on pin 14 is found (after a comparison to a predetermined stored signature, operation 32) to be a "high" value, then it may be assumed that a type B headset is plugged-in; this situation corresponds to the schematic of FIG. 3. On the other hand, if the measured signal at pin 14 is a "low" value, then it may be assumed that a type A headset is plugged-in; this corresponds to the schematic of FIG. 5. Note that the use of "high" and "low" is broadly used to merely differentiate between two distinct signatures; also, their respective ranges may be determined during laboratory testing of the audio accessory type detection process (using a sample host device and various connected audio accessories).

The same results or determinations (regarding the detected headset type) may be achieved by configuring the switch 17 into its state F3, F4=0,1, and realizing that, in that case, if the measurement on pin 13 is a low value, then a type B headset is likely to be plugged-in (FIG. 2), while if the measurement is a high value, then a type A headset is likely to be plugged-in (FIG. 4). Thereafter, the controller 23 may deactivate the ultrasonic signal and set the configuration of the switch 17 to the one associated with the closest found signature (operation 35); in this case, the switch 17 is configured into its state F3, F4=0,1 and mux=13 if a type B headset was detected, and state F3, F4=1, 0 and mux=14 if a type A headset was detected. Thereafter, the controller 23 may turn on the dc bias circuit 10 to supply power to the microphone in the connected handset, and signal the switch 18 to switch on the digital audio content out stream. In other words, the microphone bias is not turned on, and no audio is allowed to be sent to the speakers, until accessory type detection and configuration of the switch 17 has been completed. This helps avoid any audible artifacts ("clicks and pops") during the headset type detection and switch configuration process. The switch 17 may remain in this configuration until the process of FIG. 6 is triggered again, e.g. in response to another headset plug insertion event.

Note that when F3, F4=0,0, a different signature is created for a headset with a microphone vs. a headset where pin 13 is assigned to ground (return) and pin 14 is floating. This state could also be used to detect different microphone impedances as these will form different voltage dividers with the resistor R of the microphone dc bias circuit 10.

With respect to measuring the return signal on pin 13 or pin 14, there are several options including, for example, computing a ratio of the power of the measured signal relative to that of the transmitted ultrasonic signal. Another measure would be to calculate the absolute RMS value of the measured signal. The relevant frequency band used for such calculations may be centered at the fundamental frequency of the ultrasonic source 20 and its cutoff frequencies or bandwidth may be determined during laboratory testing which would reveal the effects of all of the various, expected audio accessories that might be plugged in. The bandpass filter 24 may be designed to have the same bandwidth and center frequency.

The returned signal may be viewed as the result of passing the transmitted ultrasonic test signal through the audio accessory. Another way to view this is to consider that the test signal may be applied to a pair of input pins of the connector 2, and the returned signal is measured through a third pin relative to one of the input pins. In other words, the ultrasonic signal may be "returned" to the audio host device 1 through a different pin. Thus, in the case of FIG. 3, the ultrasonic signal has been transmitted by the source 20 and passes through a single speaker on pin 11, relative to the ground pin 13. The measured signal at pin 14 is the voltage that has been developed across the microphone due to the ultrasonic signal. In other words, the ultrasonic signal traverses into the audio accessory through one pin, and is returned or measured through another pin. Note that in some cases, the measured signal is actually zero—see the case of FIG. 2.

Figure 7:
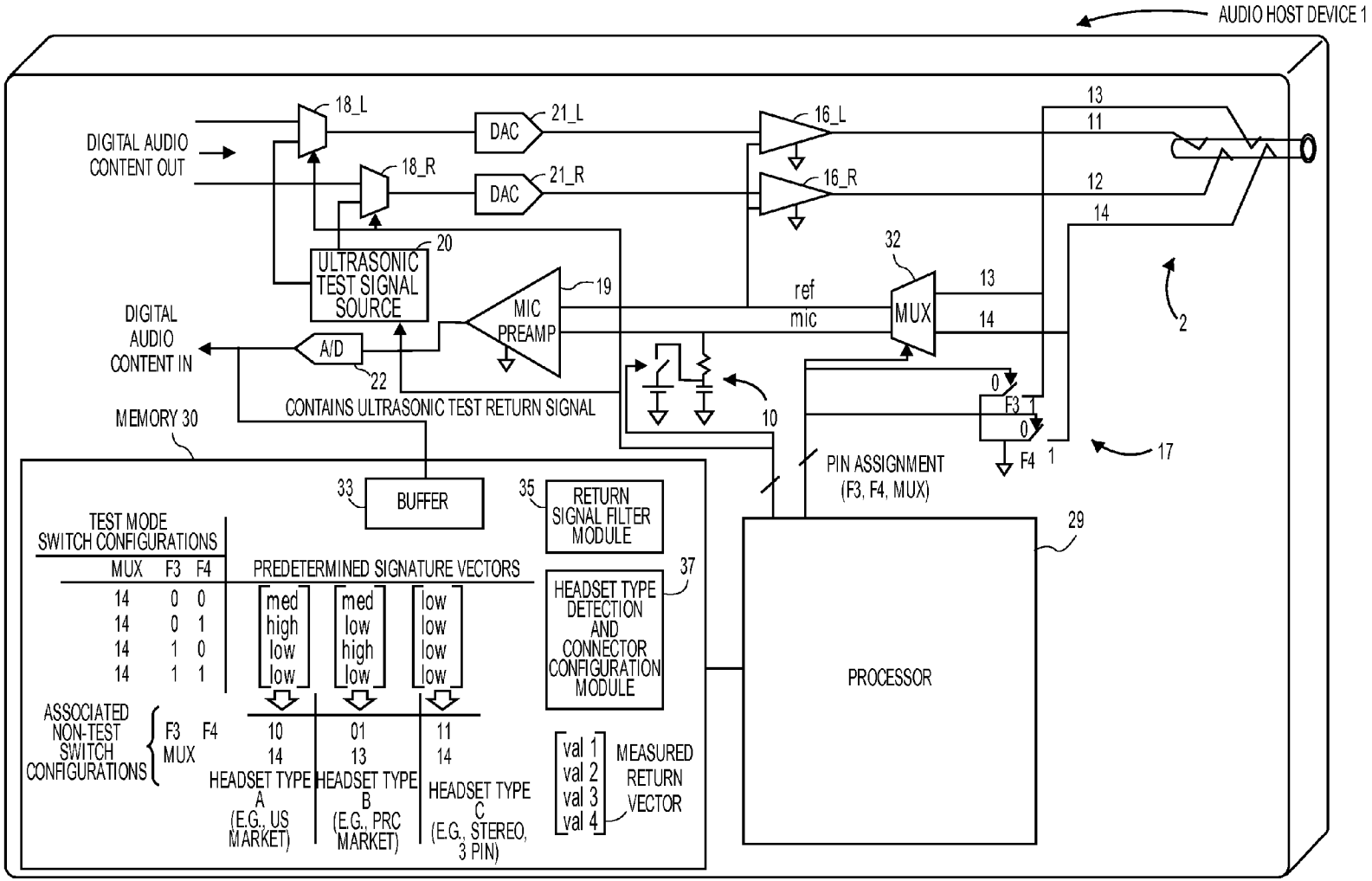
FIG. 7 is a combined circuit schematic and block diagram of relevant portions of an electronic audio host device, in accordance with another embodiment of the invention.

FIG. 7 is a combined circuit schematic and block diagram of relevant portions of the audio host device 1, in accordance with another embodiment of the invention. One difference between this embodiment and that of FIG. 1 is that there are a pair of speaker amplifiers 16_L, 16_R driving the left and right speaker channels, respectively, on pins 11, 12. Each of these channels may have its own DAC 21_L, 21_R, respectively, and switch 18_L, 18_R. The ultrasonic signal source 20 may be introduced into the right speaker channel, the left speaker channel, or, both speaker channels simultaneously (as shown).

A further difference between the embodiment of FIG. 7 and that of FIG. 1 is the use of a differential input microphone preamplifier 19, whose inputs are provided by a multiplexer 32. In one state, a multiplexer (mux) 32 routes its input signal from pin 13 to its mic output and its input signal from pin 14 to its ref output (state "13"). In another state (state "14"), those assignments are reversed. The mux 32 is part of the programmable switch circuit 17 together with the switches F3, F4, and may operate in the same manner as in the embodiment of FIG. 1. Note that the ref signal at the output of the mux 32 may also be used as a ground reference by the speaker amplifiers 16_L, 16_R.

The control signals (or pin assignment) for configuring the switch 17 in the embodiment of FIG. 7 is provided by a processor 29, that has been programmed in accordance with an audio accessory type detection and connector configuration software module 37, which is stored in memory 30. The processor 29 is programmed to measure a signal from the output of the microphone preamplifier 19, beginning with the signal in digital form as initially stored in a buffer 33 of the memory 30. The memory 30 may include mass storage devices (non-volatile memory such as flash) as well as program memory devices (typically, volatile dynamic random access memory). A digital high pass or bandpass filter operation may then be performed upon the buffered signal, using a return signal filter module 35, to extract what is expected to be the return signal of the ultrasonic source 20 (nominally within an ultrasonic frequency range that defines the highpass or bandpass filter characteristics).

The embodiment of FIG. 7 operates differently than the embodiment of FIG. 1 in that the measured signature (obtained by measuring the return signal) is actually a vector that has two or more components (signal values). It is this vector that is then compared to several predetermined stored signature vectors, to detect the correct type of audio accessory that is plugged in (and hence the correct signal pin assignment). In one embodiment, the memory 30 contains a number of predetermined signature vectors, depicted in the example of FIG. 7 as having four components or values each. Each value may take any one of in this case three discrete levels, namely low, medium and high. Note that this is just an example. There may be a situation where the vectors need only have two components, in order to be able to detect the different types of audio accessories. In other instances, larger vectors may be needed, together with a greater number of possible discrete component values.

The signature vectors may be determined during laboratory testing of the audio host device 1, by plugging in the different types of audio accessories that are expected to be used in-the-field, and measuring the return signal at each of several different test mode switch configurations of the circuit 17. Thus, in the example depicted in FIG. 7, there are at least four different configurations possible for the circuit 17. Also, each audio accessory type should be associated with a unique signature vector, although there may be instances where a single signature vector is associated with two different types of accessories. In those instances, care should be taken to ensure that both accessories can work with the same pin assignment.

Considering the vector that is associated with headset type A, this vector may be determined during laboratory testing as follows: plugging a type A headset into the connector 2; measuring the return signal at each of the several different switch configurations while the headset remains plugged in; recording the measured values (each of which may include a range to allow for some tolerance) as defining the associated signature vector; and associating that vector with the correct pin assignment (which should be obtained using one of the tested switch configurations). The process may be repeated for other headset types, in this case, including headset type B and headset type C for instance, and recording those determined signature vectors in association with their respective pin assignments, within the memory 30 of each audio host device 1 that will be produced (as shown in FIG. 7).

It is expected that by providing enough discrete component values, the different headset types will be resolved into their unique signature vectors, respectively, so that during in-the-field operation of the headset type detection process, the programmable switch circuit 17 may be cycled through two or more of its possible configurations, while measuring the return signal at each configuration, resulting in a measured vector that should correspond to one of the several different stored signature vectors. Once the vector comparison has revealed a matching stored vector, the audio accessory type has been deemed detected and so the associated switch configuration given for that particular signature vector may then be applied to the programmable switch circuit 17. The switch 17 so configured with the correct pin assignment may now be used for non-test or normal operation of the audio host device 1, with the currently plugged in audio accessory. The process is summarized in FIG. 9.

Figure 9:
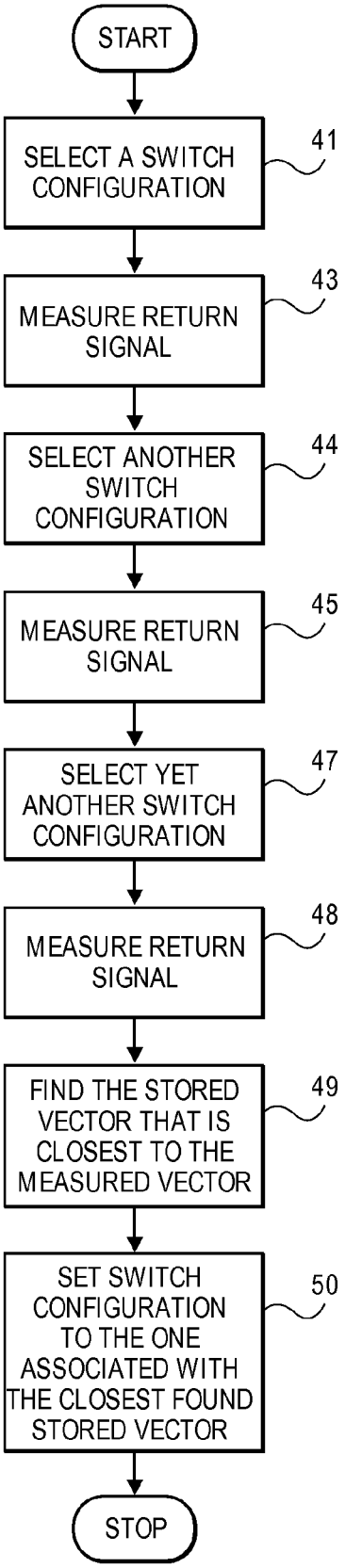
FIG. 9 is a flow diagram of another process for detecting a type of an audio accessory and configuring a programmable switch circuit to match the plugged-in audio accessory.

Referring to FIG. 9, once an audio accessory has been detected as being plugged in, operation begins with selecting a particular switch configuration (while the microphone dc bias is off, and the digital audio content out signal is unselected) (block 41). After having signaled the ultrasonic test tone to be switched into the desired pin of the connector 2, a return signal is then measured (block 43). That may include applying a suitable highpass or lowpass filter to the signal stored in the buffer 33—see FIG. 7. The measured value is then stored as part of a measured return vector data structure, within the memory 30. Operation then proceeds with selecting a different switch configuration (block 44), and repeating a measurement of the return signal (block 45). The second measured value is also stored as part of the return vector, within the memory 30. The process then repeats with selecting yet another switch configuration (block 47), measuring the return signal again and recording the associated value as part of the measured return vector (block 48). This may continue until the measured return vector has been completely filled. Operation may then proceed with a comparison in which the stored (predetermined) signature vector that is closest to the measured vector is found in the memory 30 (block 49). Next, the pin assignment that is associated with the closest found stored vector is read from the memory 30 and then applied to the programmable switch circuit 17. The ultrasonic tone may now be unselected or switched out, the digital audio content out signal may be selected or switched in, and the microphone dc bias may be turned on. At this point, the correct signals are being routed to the connector 2, for the particular plugged in audio accessory, and so the audio host device 1 is ready to transfer any digital audio content in and out of the plugged in audio accessory.

There may be a circumstance where none of the predetermined signatures appear to be sufficiently close to (or match) a given measured return signal value or vector. In such an instance, this may trigger the processor 29 to execute additional software that causes it to read a stored region code of the audio host device 1 (e.g., stored in the memory 30). The region code indicates which consumer market the device 1 is intended for, and may have been set by a manufacturer of the audio host device 1. The region code may be part of the manufacture's serial number for the audio host device 1. The processor 29 then performs a lookup into a table or data structure (stored in the memory 30), as depicted in FIG. 10, for example, to obtain a pin assignment that is associated with the read region code. For example, if the region code indicates the North American (NA) market, the stored pin assignment that is associated with that region code could be the A configuration described above, which corresponds to headset type A. The table may have several different pin assignments as shown. It may have been written during manufacture of the audio host device 1, or during a software update for the audio host device 1. The different pin assignments are associated with different region codes, corresponding to those regions in which the different specimens of the audio host device 1 are expected to be sold (for in-the-field use). Based on a lookup being performed upon such a table, the programmable switch circuit 17 would then be configured accordingly, or its current configuration could be validated.

Figure 6:
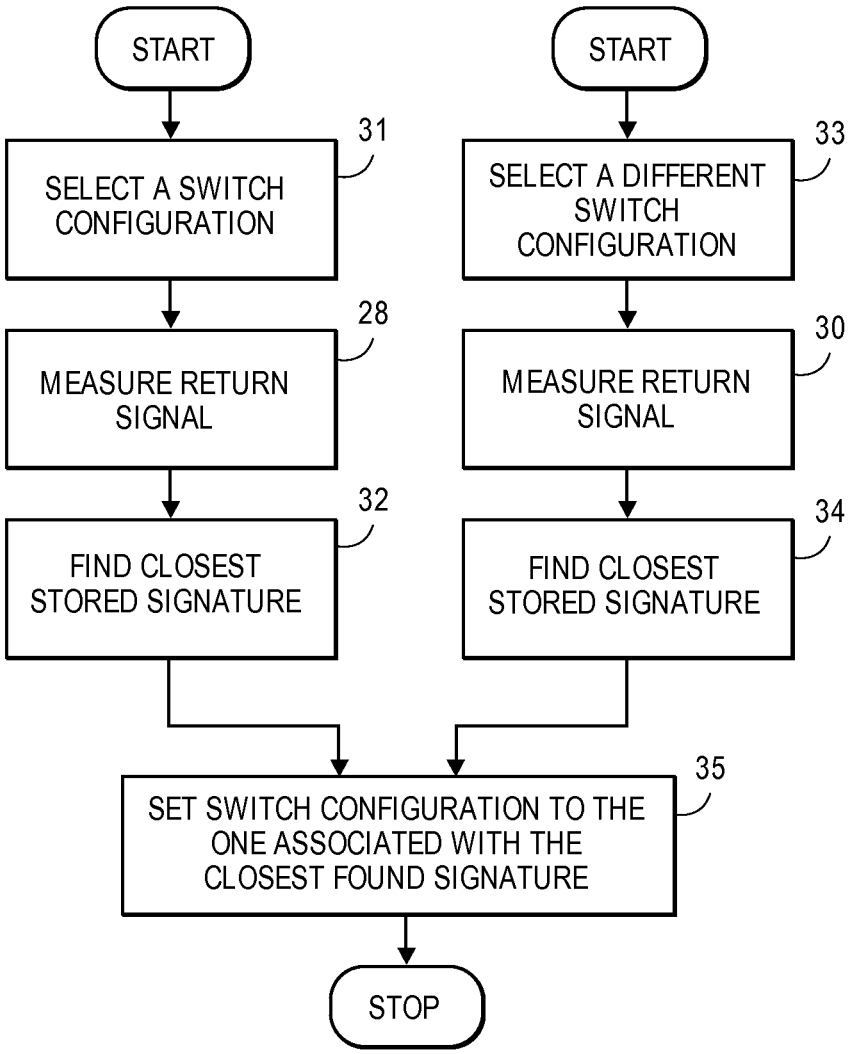
FIG. 6 is flow diagram of a process for detecting a type of an audio accessory and configuring a programmable switch circuit to match the plugged-in audio accessory.

If the current configuration of the circuit 17, either by default or following execution of the above-described audio accessory type detection processes of FIG. 6 or FIG. 9, differs from the pin assignment obtained from the region code based table lookup, then the processor 29 may be programmed to prompt the user of the audio host device 1 to, for instance, alert the user of the discrepancy, or to request that the user confirm her knowledge of the actual type of headset or audio accessory that is plugged in to the connector 2.

In accordance with another embodiment of the invention, the above-described processes for automatic detection of the audio accessory type are combined with input from the user, in order to improve the chances that the correct pin assignment has been selected. Operation may begin with prompting the user to input her confirmation as to whether or not the audio accessory that is currently plugged into the connector 2 is operating properly, while the programmable switch circuit 17 has been configured with a selected one of the several available pin assignments. The selected pin assignment may have been based on the results of the signature comparison formed by the automatic processes described above in connection with FIG. 6 or FIG. 9. The programmed processor 29 may transmit audio content out through one or more of the speaker channels of the connector 2, while prompting the user to indicate whether she can hear proper sound through the speakers of the audio accessory. In another instance, the programmed processor 29 may begin recording audio content in, which is being delivered through the connector 2, while prompting the user to speak into the microphone of the plugged-in audio accessory. The programmed processor 29 may then play back the recorded digital audio content in, and prompt the user to confirm whether or not the audio accessory that is plugged in appears to be working properly.

In addition, the processor 29 will store the measured return signal (or measured vector, in the case of FIG. 7) in association with the user's confirmation, together with the selected pin assignment, as part of a single entry in a database of audio accessory types (e.g., within the memory 30). FIG. 11 depicts an example data structure for this purpose, showing three different instances of a combination of a selected pin assignment, measured return signal or vector, and the associated user confirmation. Such a data structure may be accessed, by the controller 23 or by the programmed processor 29, each time the user of the device 1 plugs in an audio accessory. This data structure may help achieve a more reliable decision on which pin assignment to adopt for a given plugged in audio accessory.

In a further embodiment of the invention, the user may be prompted to input an indication as to which type of audio accessory is currently plugged into the connector 2. This assumes that the user knows which audio accessory type is plugged in. The controller 23 or processor 29 would then perform a table lookup for the pin assignment that is associated with the type of audio accessory that was indicated by the user, in a data structure similar to that of FIG. 10 or FIG. 11. The automatic process of FIG. 6 or FIG. 9 may be performed, and then if its results match the headset type indicated by the user, then the process (including its stored signature and associated pin assignment) has been in essence verified.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio accessory depicted in the drawings and described in the text is a headset, the described pin assignment techniques can also be applied to connectors for other types of cabled audio accessories such as portable shelf-type speakers and detachable microphones. Also, while the introduction of the transmitted ultrasonic test signal can be performed in the digital domain (using a digital switch, as shown in FIG. 1 and in FIG. 7), it may alternatively be performed in the analog domain, e.g., using an analog switch that is between the output of the DAC 21 and the input of the speaker amplifier 16. The description is thus to be regarded as illustrative instead of limiting.

What is claimed is:

1. An electronic audio host device comprising:

an audio accessory connector having a plurality of pins;

an ultrasonic test signal source having an output coupled to a first pin of the connector;

a programmable switch circuit that couples one of a second pin and a third pin of the connector, to a ground of the audio host device; and a controller coupled to program the switch circuit, based on having measured a return signal on one of the plurality pins of the connector while an ultrasonic test signal is being sent through the connector, and compared the measured signal to a predetermined, stored signature, wherein the predetermined stored signature is associated with one of a plurality of different accessory plug pin assignments for the connector that can be configured using the programmable switch circuit.

2. The audio host device of claim 1 further comprising a microphone signal amplifier, wherein the programmable switch circuit comprises a multiplexer that can be configured by the controller to couple any one of the second pin and the third pin at a time, to an input of the microphone signal amplifier.

3. The audio host device of claim 2 further comprising a dc voltage source coupled to a signal output of the multiplexer, wherein the controller is to maintain the dc voltage source off until after the switch circuit has been configured with a final pin assignment.

4. The audio host device of claim 1 wherein the controller is to set each of the plurality of different pin assignments one at a time, by programming the switch circuit, each time measuring a signal on one of the pins of the connector while the ultrasonic test signal is being sent through the connector, to create a measured return vector, and compare the measured return vector to a predetermined, stored signature vector and on that basis configure the programmable switch circuit to set a final pin assignment for the connector.

5. The audio host device of claim 4 wherein the controller comprises memory having stored therein a plurality of predetermined, signature vectors, each vector being associated with a different type of audio accessory that can be plugged into the connector.

6. The audio host device of claim 1 wherein the controller is to read a stored region code of the device from memory, wherein the region code indicates which consumer market the device is intended for, and to lookup a stored pin assignment that is associated with the read region code, and wherein the controller is to validate a configuration of the programmable switch circuit based on the looked up pin assignment.

7. The audio host device of claim 1 wherein the controller is to prompt a user of the device to input a confirmation as to whether or not an audio accessory that is currently plugged into the connector, while the programmable switch circuit has been configured with a selected one of the pin assignments, is operating properly, the controller to store the measured return signal in association with the user's confirmation and the selected pin assignment as a single entry in a database of audio accessory types.

8. The audio host device of claim 1 wherein the controller is to prompt the user to input an indication as to which type of audio accessory is plugged into the connector, the controller to program the switch circuit with a selected one of the pin assignments being based on the user's indication, and store the measured return signal in association with the user's indication and the selected pin assignment.

9. A method in an electronic device for adapting to connector pin assignments of a plurality of different audio accessories that can be connected to the device, the method comprising:

transmitting a predetermined ultrasonic tone signal through a first pin of a connector in the device;

while the ultrasonic tone signal is being transmitted, measuring a signal through a second pin of the connector;

comparing the measured signal to a predetermined, stored signature, wherein the predetermined stored signature is associated with one of a plurality of different accessory plug pin assignments that can be configured in the device for the connector; and configuring a programmable switch circuit to set a pin assignment for the connector, based on the comparison.

10. The method of claim 9 wherein the ultrasonic signal has essentially no signal components below about 20 kHz.

11. The method of claim 9 further comprising:

configuring the programmable switch circuit to set each of the plurality of different pin assignments one at a time, by performing the transmitting and measuring each time, to create a measured return vector; and comparing the measured return vector to a predetermined, stored signature vector; and configuring the programmable switch circuit to set the pin assignment for the connector, based on the vector comparison.

12. The method of claim 9 wherein the transmitting a predetermined ultrasonic tone signal through a first pin comprises transmitting the signal through a speaker channel pin, and the measuring a signal through a second pin comprises measuring a signal at a non-speaker channel pin.

13. The method of claim 9 wherein the second pin is assigned one of a microphone signal and a ground signal.

14. The method of claim 9 wherein the plurality of different pin assignments number at least three, namely 1) a US-market headset pin assignment, 2) a China-market headset pin assignment, and 3) another type of headset pin assignment.

15. The method of claim 14 wherein the another type of headset pin assignment is for a stereo and no microphone headset.

16. The method of claim 9 further comprising:

reading a stored region code of the device, wherein the region code indicates which consumer market the device is intended for;

looking up a stored pin assignment that is associated with the read region code; and validating configuration of the programmable switch circuit based on the looked up pin assignment.

17. The method of claim 9 further comprising:

prompting the user to input a confirmation as to whether or not an audio accessory that is plugged-in to the connector, while the programmable switch circuit has been configured with a selected one of the pin assignments which is based on the comparison, is operating properly; and storing the measured signal in association with the user's confirmation and the selected pin assignment, as a single entry in a database of audio accessory types.

18. The method of claim 9 further comprising:

prompting the user to input an indication as to which type of audio accessory is plugged-in to the connector, wherein the programmable switch circuit is configured with a selected one of the pin assignments which is based on the user's indication; and storing the measured signal in association with the user's indication and the selected pin assignment.

19. The method of claim 9 further comprising, after the configuring to set the pin assignment, turning on a dc voltage source to provide power out to an audio accessory through the connector.

20. The method of claim 9 wherein no dc voltage is being sent out to an audio accessory through the connector, while the transmitting, measuring, comparing and configuring operations are being performed.

21. An audio host device comprising:

means for coupling with an audio accessory, including first, second and third pins;

means for generating an ultrasonic test signal;

means for routing one of the first and second pins of the coupling means to a ground of the audio host device; and means for measuring a signal on one of the first and second pins while the ultrasonic test signal is on, and comparing the measured signal to a predetermined, stored signature, wherein the predetermined stored signature is associated with one of a plurality of different accessory plug pin assignments with which the routing means can be configured; and means for configuring the routing means based on the comparison.

* * * * *